US006756551B2

(12) United States Patent
Wong

(10) Patent No.: US 6,756,551 B2
(45) Date of Patent: Jun. 29, 2004

(54) PIEZOELECTRICALLY ACTUATED LIQUID METAL SWITCH

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/142,076

(22) Filed: May 9, 2002

(65) Prior Publication Data

US 2003/0209414 A1 Nov. 13, 2003

(51) Int. Cl.[7] ..... H01H 29/02
(52) U.S. Cl. ..... 200/214; 200/182
(58) Field of Search ..... 200/181–286, 200/61.02, 600; 310/328

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Von Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 4,103,135 A | | 7/1978 | Gomez et al. | |
| 4,200,779 A | | 4/1980 | Zakurdaev et al. | |
| 4,238,748 A | | 12/1980 | Goullin et al. | |
| 4,245,886 A | | 1/1981 | Kolodzey et al. | |
| 4,336,570 A | * | 6/1982 | Brower et al. | 362/4 |
| 4,419,650 A | | 12/1983 | John | |
| 4,434,337 A | | 2/1984 | Becker | |
| 4,475,033 A | | 10/1984 | Willemsen et al. | |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | SHO 36-18575 | 10/1961 |
| JP | SHO 47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99/46624 | 12/1999 |

OTHER PUBLICATIONS

Marvin Glenn Wong, "Laser Cut Channel Plate For A Switch", Patent application (Agilent Docket No. 10020698–1 SN: 10/317932 filed Dec. 12, 2002), 11 pages of specifications, 5 pages of claims, 1 page of abstract, and 4 sheets of formal drawings (Fig. 1–10).

(List continued on next page.)

*Primary Examiner*—Elvin Enad
*Assistant Examiner*—Lisa Klaus
(74) *Attorney, Agent, or Firm*—Regan L. Trumper

(57) ABSTRACT

The present invention uses a piezoelectric method to actuate a liquid metal relay. The method described here uses the piezoelectric element in an extension mode to cause the switch actuator to insert into a cavity in the static (i.e. nonmoving) switch contact structure. The cavity has sides and a pad on its end that are wettable by the liquid metal. The cavity is filled with liquid metal. Insertion of the switch actuator into the cavity causes the liquid metal to be displaced outward and come in contact with the contact pad on the switch actuator. The volume of liquid metal is chosen so that when the actuator returns to its rest position, the electrical contact is maintained by surface tension and by wetting of the contact pads on both the static switch contact structure and the actuator.

14 Claims, 1 Drawing Sheet

U.S. PATENT DOCUMENTS 4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A * 10/1997 Smith ..... 361/234
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A * 11/1999 Yagi ..... 257/415
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

OTHER PUBLICATIONS

Homi C. Bhedwar et al., "Ceramic Multilayer Package Fabrication", Nov. 1989, Electronic Materials Handbook, vol. 1 Packaging, Section 4: pp. 460–469.

Marvin Glenn Wong, "A Piezoelectrically Actuated Liquid Metal Switch", May 2, 2002, patent application (pending), 12 pages of specification, 5 pages of claims, 1 page of abstract, and 10 sheets of drawings (Fig. 1–10).

Jonathan Simon et al., "A Liquid–Filled Microrelay With A Moving Mercury Microdrop", Journal of Microelectromechanical Systems, vol. 6, No. 3, Sep. 1977, pp. 208–216.

Joonwon Kim et al., "A Micromechanical Switch With Electrostatically Driven Liquid–Metal Droplet", 4 pages.

TDB–ACC–NO: NB8406827, "Integral Power Resistors For Aluminum Substrate", IBM Technical Disclosure Bulletin, Jun. 1984, US, vol. 27, Issue No. 1B, p. 827.

* cited by examiner

PIEZOELECTRICALLY ACTUATED LIQUID METAL SWITCH

BACKGROUND

Piezoelectric materials and magnetostrictive materials (collectively referred to below as "piezoelectric materials") deform when an electric field or magnetic field is applied. Thus piezoelectric materials, when used as an actuator, are capable of controlling the relative position of two surfaces.

Piezoelectricity is the general term to describe the property exhibited by certain crystals of becoming electrically polarized when stress is applied to them. Quartz is a good example of a piezoelectric crystal. If stress is applied to such a crystal, it will develop an electric moment proportional to the applied stress.

This is the direct piezoelectric effect. Conversely, if it is placed in an electric field, a piezoelectric crystal changes its shape slightly. This is the inverse piezoelectric effect.

One of the most used piezoelectric materials is the aforementioned quartz. Piezoelectricity is also exhibited by ferroelectric crystals, e.g. tourmaline and Rochelle salt. These already have a spontaneous polarization, and the piezoelectric effect shows up in them as a change in this polarization. Other piezoelectric materials include certain ceramic materials and certain polymer materials. Since they are capable of controlling the relative position of two surfaces, piezoelectric materials have been used in the past as valve actuators and positional controls for microscopes. Piezoelectric materials, especially those of the ceramic type, are capable of generating a large amount of force. However, they are only capable of generating a small displacement when a large voltage is applied. In the case of piezoelectric ceramics, this displacement can be a maximum of 0.1% of the length of the material. Thus, piezoelectric materials have been used as valve actuators and positional controls for applications requiring small displacements.

Two methods of generating more displacement per unit of applied voltage include bimorph assemblies and stack assemblies. Bimorph assemblies have two piezoelectric ceramic materials bonded together and constrained by a rim at their edges, such that when a voltage is applied, one of the piezoelectric materials expands. The resulting stress causes the materials to form a dome. The displacement at the center of the dome is larger than the shrinkage or-expansion of the individual materials. However, constraining the rim of the bimorph assembly decreases the amount of available displacement. Moreover, the force generated by a bimorph assembly is significantly lower than the force that is generated by the shrinkage or expansion of the individual materials.

Stack assemblies contain multiple layers of piezoelectric materials interlaced with electrodes that are connected together. A voltage across the electrodes causes the stack to expand or contract. The displacements of the stack are equal to the sum of the displacements of the individual materials. Thus, to achieve reasonable displacement distances, a very high voltage or many layers are required. However, conventional stack actuators lose positional control due to the thermal expansion of the piezoelectric material and the material(s) on which the stack is mounted.

Due to the high strength, or stiffness, of piezoelectric material, it is capable of opening and closing against high forces, such as the force generated by a high pressure acting on a large surface area. Thus, the high strength of the piezoelectric material allows for the use of a large valve opening, which reduces the displacement or actuation necessary to open or close the valve.

With a conventional piezoelectrically actuated relay, the relay is "closed" by moving a mechanical part so that two electrode components come into electrical contact. The relay is "opened" by moving the mechanical part so that the electrode components are no longer in electrical contact. The electrical switching point corresponds to the contact between the electrode components of the solid electrodes.

Liquid metal micro switches have been developed that use liquid metal as the switching element and the expansion of a gas when heated to actuate the switching function. The liquid metal has some advantages over other micromachined technologies, such as the ability to switch relatively high power ( approximately 100 mW) using metal-to-metal contacts without microwelding, the ability to carry this much power without overheating the switch mechanism and adversely affecting it, and the ability to latch the switching function. However, the use of a heated gas to actuate the switch has several disadvantages. It requires a relatively large amount of power to change the state of the switch, the heat generated by switching must be rejected effectively if the switch duty cycle is high, and the actuation speed is relatively slow, i.e., the maximum switching frequency is limited to several hundred Hertz.

SUMMARY

The present invention uses a piezoelectric method to actuate liquid metal switches. The actuator of the invention uses piezoelectric elements in an extension mode rather than in a bending mode. A piezoelectric driver in accordance with the invention is a capacitive device which stores energy rather than dissipating energy. As a result, power consumption is much lower, although the required voltages to drive it may be higher. Piezoelectric pumps may be used to pull as well as push, so there is a double-acting effect not available with an actuator that is driven solely by the pushing effect of expanding gas. Reduced switching time results from use of piezoelectric switches in accordance with the invention.

The present invention uses a piezoelectric method to actuate a liquid metal relay. The method described here uses the piezoelectric element in an extension mode to cause the switch actuator to insert into a cavity in the static (i.e. nonmoving) switch contact structure. The cavity has sides and a pad on its end that are wettable by the liquid metal. The cavity is filled with liquid metal. Insertion of the switch actuator into the cavity causes the liquid metal to be displaced outward and come in contact with the contact pad on the switch actuator. The volume of liquid metal is chosen so that when the actuator returns to its rest position, the electrical contact is maintained by surface tension and by wetting of the contact pads on both the static switch contact structure and the actuator.

When the switch actuator retracts away from the static switch contact structure, the available volume for liquid metal inside the static switch contact structure increases and combination of the movement of the liquid metal into the cavity and the contact pad on the switch actuator moving away from the bulk of the liquid metal causes the liquid metal connection between the static and moving contact pads to be broken. When the switch actuator returns to its rest position, the contact remains electrically open because there is not enough liquid metal to bridge the gap without being disturbed. The switch actuator may have a coating that is wettable by the liquid metal on the part that is inserted into the liquid metal. This coating is not connected with the contact pad and exists to promote the "sucking back" of the liquid metal when the switch actuator retracts.

DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION OF THE INVENTION

Figure 1:
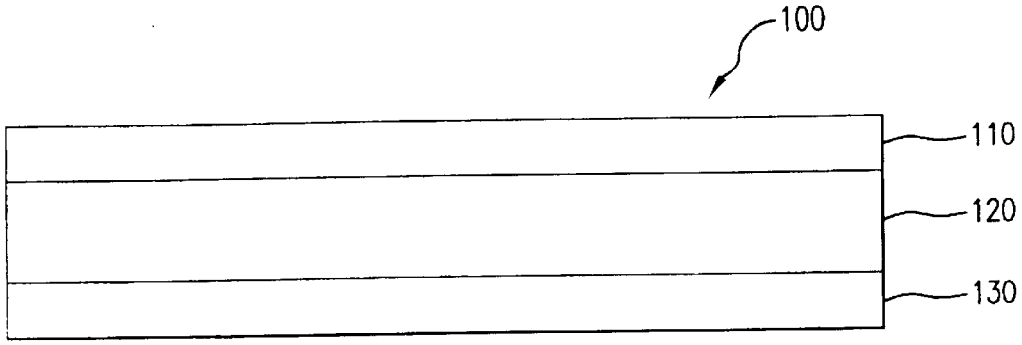
FIG. 1 shows a side view of the layers of a piezoelectric metal switch in accordance with the invention.

FIG. 1 is a side view of an embodiment of the invention showing three layers of a relay 100. The top layer 110 is a cap layer. The cap layer 110 acts to provide a protective layer to prohibit external influence on the relay 100. The second layer 120 is a piezoelectric layer. The piezoelectric layer 120 houses the non-static elements of the relay 100. The substrate layer 130 acts as a base and provides a common foundation for a plurality of circuit elements that may be present.

Figure 2:
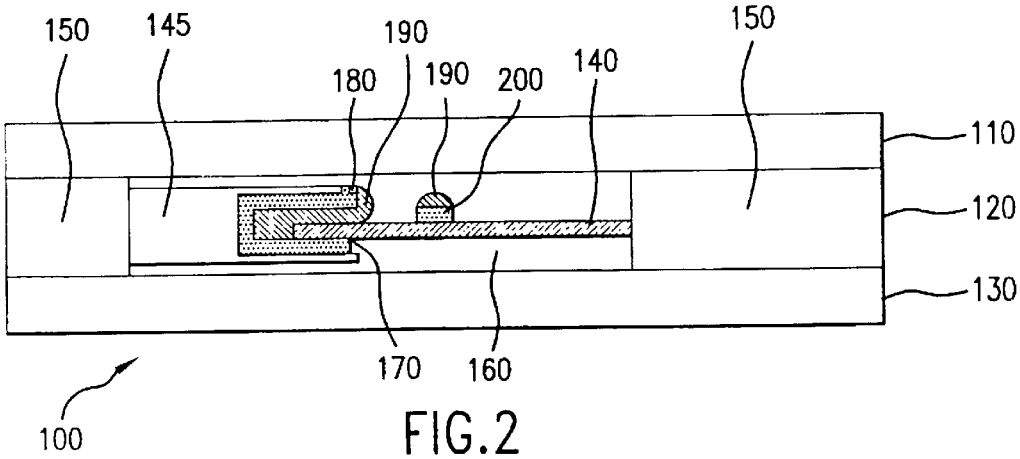
FIG. 2 shows a side cross section of a side view of the piezoelectric layer of a switch in accordance with the invention in an open state.

FIG. 2 shows a cross sectional view of an embodiment of a relay 100 in accordance with the invention. FIG. 2 is a cross sectional view of FIG. 1. The piezoelectric layer 120 houses a piezoelectric element 140 utilized in the relay 100. The piezoelectric element 140 (also synonymously referred to in this description as a switch actuator) extends from a substrate material 150. The substrate material 150 forms the sides of a chamber 160. A non-conductive attachment 145 is attached to the substrate material opposite the piezoelectric element 140. The non-conductive material 150 generally forms a shape having a cavity 170. The cavity is lined with a conductive material which functions as a switch contact 180. The cavity 170 is filled with a liquid metal 190. The piezoelectric element 140 extends into the cavity 170. The piezoelectric element 140 displaces a portion of the liquid metal 190 forcing it to bulge out of the cavity 170. A second switch contact 200 is attached to the piezoelectric element 140. An amount of the liquid metal 190 adheres to the piezoelectric element 140. Circuit traces (not shown) run through the attachment 145 and the piezoelectric element 140 connecting to the switch contacts 180,200. Circuit traces for the piezoelectric element 140 are also not shown.

In a preferred embodiment of the invention, the liquid metal 190 is mercury. In an alternate preferred version of the invention, the liquid metal is an alloy containing gallium. It is understood by those skilled in the art that the switch contact 180 and the attachment 145 are respectively adhered in any manner capable of providing sufficient adhesion. Preferably, the switch contact 180 is laminated to the piezoelectric element 140 and the attachment is adhered to the substrate material 150.

In operation, the present invention uses a piezoelectric method to actuate a liquid metal relay. The method described here uses the piezoelectric element 140 in an extension mode to cause the switch actuator to insert into a cavity 170 in the attachment 145. The cavity 170 has sides and a pad (referred to above as a switch contact 180) on its end that are wettable by the liquid metal. The cavity is filled with liquid metal 190. Insertion of the piezoelectric element 140 into the cavity 170 causes the liquid metal 190 to be displaced outward and come in contact with the contact pad 200 on the switch actuator 140. The volume of liquid metal 190 is chosen so that when the actuator 140 returns to its rest position, the electrical contact is maintained by surface tension and by wetting of the contact pads 180,200 on both the static switch contact structure 145 and the actuator 140.

When the switch actuator 140 retracts away from the static switch contact structure 145, the available volume for liquid metal 190 inside the static switch contact structure 145 increases and combination of the movement of the liquid metal 190 into the cavity 170 and the contact pad 200 on the switch actuator 140 moving away from the bulk of the liquid metal 190 causes the liquid metal 190 connection between the static 190 and moving contact pads 200 to be broken. When the switch actuator 140 returns to its rest position, the contact remains electrically open because there is not enough liquid metal 190 to bridge the gap without being disturbed. The switch actuator 140 may have a coating that is wettable by the liquid metal on the part that is inserted into the liquid metal 190. This coating is not connected with the contact pad 200 and exists to promote the "sucking back" of the liquid metal 190 when the switch actuator 140 retracts.

Figure 3:
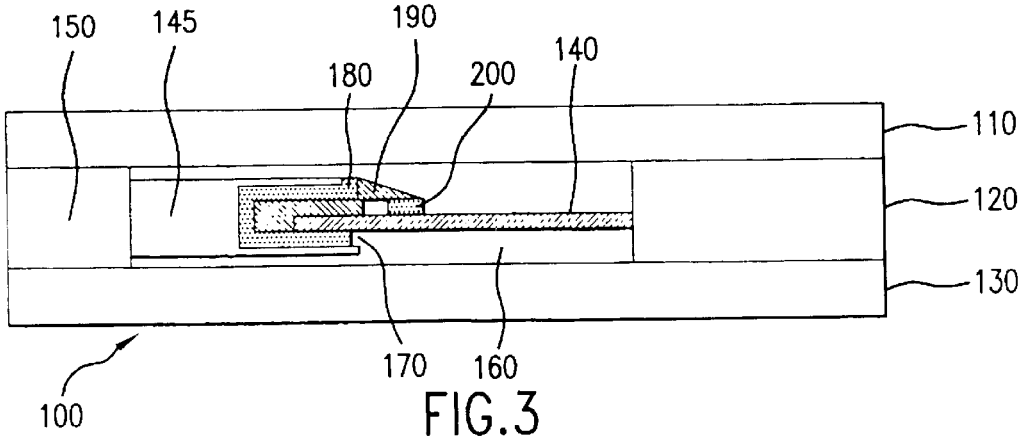
FIG. 3 shows a side cross-section of a side view of the piezoelectric layer of a switch in accordance with the invention in a closed state.

FIG. 3 is a cross-sectional view of an embodiment of a relay in accordance with the invention showing the relay in a closed state. The switch actuator 140 has been extended into the liquid metal 190 causing displacement of the liquid metal 190. The liquid metal 190 has come in contact with the switch contact 200 on the switch actuator 140. The electrical connection between the switch contacts 180,200 is maintained due to the surface tension and by wetting of the contact pads 180,200.

While only specific embodiments of the present invention have been described above, it will occur to a person skilled in the art that various modifications can be made within the scope of the appended claims.

What is claimed is:

1. A piezoelectric activated relay comprising:

an extension mode piezoelectric element;

a switch contact structure forming a cavity;

a first switch contact pad and a second switch contact pad, said first switch contact pads being constructed to line said cavity and said second switch contact pad being adhered to said piezoelectric element; and a first portion of liquid metal filling said cavity and a second portion of liquid metal adhering to said second contact switch;

wherein said piezoelectric element extends partially into said cavity contacting said liquid metal and wherein said second switch contact pad is positioned on said piezoelectric element in close proximity to said first portion of liquid metal so that actuation of the piezoelectric element causes outward displacement of the first portion of liquid metal causing it to contact the second contact pad and the second portion of liquid metal.

2. The relay of claim 1, wherein said liquid metal is mercury.

3. The relay of claim 1, wherein said liquid metal is an alloy containing gallium.

4. The relay of claim 2, further comprising a cap material positioned atop the relay and a circuit substrate material positioned below the relay.

5. The relay of claim 4, wherein said piezoelectric element is coated on a portion of the piezoelectric element that extends into said cavity, said coating being wettable by the liquid metal.

6. The relay of claim 5, wherein said first and second portions of liquid metal remain in contact with each other and wetted to said first and second switch contacts when said piezoelectric element retracts to a resting position.

7. The relay of claim 6, wherein said first and second portions of liquid metal lose contact with each other when said piezoelectric element retracts from its resting position.

8. A piezoelectric activated relay comprising:

a cap layer;

a piezoelectric layer positioned beneath said cap layer; and a circuit substrate layer positioned beneath said piezoelectric layer;

wherein said piezoelectric layer comprises an extension mode piezoelectric element; a switch contact structure forming a cavity; a first switch contact pad and a second switch contact pad, said first switch contact pads being constructed to line said cavity and said second switch contact pad being adhered to said piezoelectric element; and a first portion of liquid metal filling said cavity and a second portion of liquid metal adhering to said second contact switch; wherein said piezoelectric element extends partially into said cavity contacting said liquid metal and wherein said second switch contact pad is positioned on said piezoelectric element in close proximity to said first portion of of liquid metal so that actuation of the piezoelectric element causes outward displacement of the first portion of liquid metal causing it to contact the second contact pad and the second portion of liquid metal.

9. The relay of claim 8, wherein said liquid metal is mercury.

10. The relay of claim 8, wherein said liquid metal is an alloy containing gallium.

11. The relay of claim 9, further comprising a cap material positioned atop the relay and a circuit substrate material positioned below the relay.

12. The relay of claim 11, wherein said piezoelectric element is coated on a portion of the piezoelectric element that extends into said cavity, said coating being wettable by the liquid metal.

13. The relay of claim 12, wherein said first and second portions of liquid metal remain in contact with each other and wetted to said first and second switch contacts when said piezoelectric element retracts to a resting position.

14. The relay of claim 13, wherein said first and second portions of liquid metal lose contact with each other when said piezoelectric element retracts from its resting position.

* * * * *